US008479925B2

(12) United States Patent
Brown et al.

(10) Patent No.: US 8,479,925 B2
(45) Date of Patent: Jul. 9, 2013

(54) DISPLAY SYSTEM

(75) Inventors: Paul Christopher Brown, Elgin, SC (US); Thomas A. Caputo, Greensboro, NC (US); Grant Rorie Phillips, Columbia, SC (US); Martin Richard Van Buren, Atlanta, GA (US)

(73) Assignee: Newell Window Furnishings, Inc., High Point, NC (US)

( * ) Notice: Subject to any disclaimer, the term of this patent is extended or adjusted under 35 U.S.C. 154(b) by 0 days.

(21) Appl. No.: 12/839,027

(22) Filed: Jul. 19, 2010

(65) Prior Publication Data

US 2012/0012542 A1 Jan. 19, 2012

(51) Int. Cl.
*A47F 7/00* (2006.01)

(52) U.S. Cl.
USPC ..... 211/26; 211/94.01; 211/189

(58) Field of Classification Search
USPC ..... 211/26, 94.01, 189, 13.1, 26.1, 180; 361/724, 727, 729, 683, 679.02, 679.04, 361/679.21; 83/929; 29/24.5
See application file for complete search history.

(56) References Cited

U.S. PATENT DOCUMENTS

| | | | |
|---|---|---|---|
| 239,691 | A | 4/1881 | Appleton |
| 421,027 | A | 2/1890 | Hammond |
| 702,200 | A | 6/1902 | Greene |
| 1,382,433 | A | 6/1921 | McCarty |
| 1,647,254 | A | 11/1927 | Simmons |
| 1,721,276 | A | 7/1929 | Marsilius |
| 1,792,522 | A | 2/1931 | Yates |
| 1,924,162 | A | 8/1933 | Mason |
| 2,044,481 | A | 6/1936 | Manley et al. |
| 2,057,488 | A | 10/1936 | Hochstadt |
| 2,247,314 | A | 6/1941 | Sellmeyer |
| 2,418,515 | A | 4/1947 | Lewis |
| D155,897 | S | 11/1949 | Huntington |
| 2,631,508 | A | 3/1953 | Muehling |
| 2,644,520 | A | 7/1953 | Nelson |
| 2,691,994 | A | 10/1954 | Ferguson |
| 2,747,625 | A | 5/1956 | Small |
| 2,789,639 | A | 4/1957 | Lorentzen |
| 2,806,493 | A | 9/1957 | Gaskell |

(Continued)

FOREIGN PATENT DOCUMENTS

| | | |
|---|---|---|
| CA | 2136519 A1 | 5/1996 |
| CA | 2355507 A1 | 2/2003 |

(Continued)

OTHER PUBLICATIONS

U.S. Appl. No. 12/579,892 dated Oct. 15, 2009.

(Continued)

*Primary Examiner* — Korie H Chan
(74) *Attorney, Agent, or Firm* — Dennis J. Williamson; Moore & Van Allen PLLC

(57) ABSTRACT

A display for a shelving unit of the type having a bay defined in part by lower and upper horizontal supports that comprises a first rail mounted on the lower horizontal support and a second rail mounted on the upper horizontal support. A body is disposed between the first and second rails. The body is in free moving contact with the first rail and the second rail such that the body is freely movable along the length of the rails. The body supports a user interface device. The display of the invention may be used where the user interface controls the functions of a co-located machine.

20 Claims, 3 Drawing Sheets

U.S. PATENT DOCUMENTS

| | | | | |
|---|---|---|---|---|
| 2,827,686 | A | 3/1958 | Adelman | |
| 2,883,736 | A | 4/1959 | Crane | |
| 2,949,943 | A | 8/1960 | Islandsrud | |
| 2,987,085 | A | 6/1961 | Porter | |
| 3,260,146 | A | 7/1966 | Child | |
| 3,263,544 | A | 8/1966 | Margolien | |
| 3,292,232 | A | 12/1966 | Nilsson | |
| 3,391,591 | A | 7/1968 | Funke | |
| 3,470,926 | A | 10/1969 | Dohm | |
| 3,513,740 | A | 5/1970 | Burghart | |
| 3,564,893 | A | 2/1971 | Richards et al. | |
| 3,584,380 | A | 6/1971 | Mehler et al. | |
| 3,618,297 | A | 11/1971 | Hamrick | |
| 3,634,975 | A | 1/1972 | Hensley | |
| 3,664,221 | A | 5/1972 | Breetvelt | |
| 3,677,117 | A | 7/1972 | Cutter | |
| 3,715,946 | A | 2/1973 | Kaltenbach | |
| 3,736,631 | A | 6/1973 | Edixhoven | |
| 3,750,509 | A | 8/1973 | Kruse | |
| 3,766,815 | A | 10/1973 | Edixhoven | |
| 4,018,188 | A | 4/1977 | Burdette | |
| 4,036,092 | A | 7/1977 | Kaltenbach | |
| 4,055,206 | A | 10/1977 | Griffin | |
| 4,067,252 | A | 1/1978 | Peddinghaus et al. | |
| 4,139,043 | A | 2/1979 | Donofrio | |
| 4,151,768 | A | 5/1979 | Shockovsky | |
| 4,188,693 | A | 2/1980 | Edixhoven | |
| 4,201,256 | A | 5/1980 | Truhan | |
| 4,214,493 | A | 7/1980 | Elhaus | |
| 4,227,902 | A | 10/1980 | Olson | |
| 4,230,005 | A | 10/1980 | Varga | |
| 4,233,782 | A | 11/1980 | Perrault | |
| 4,262,564 | A | 4/1981 | Kaltenbach | |
| 4,270,253 | A | 6/1981 | Herb et al. | |
| 4,326,864 | A | 4/1982 | Sittler | |
| 4,338,710 | A | 7/1982 | Stursa et al. | |
| 4,367,665 | A | 1/1983 | Terpstra et al. | |
| 4,407,614 | A | 10/1983 | Muhr et al. | |
| 4,457,197 | A | 7/1984 | Wepner et al. | |
| 4,468,995 | A | 9/1984 | Mireles-Saldivar | |
| 4,492,301 | A | 1/1985 | Inaba et al. | |
| 4,545,100 | A | 10/1985 | Gaillard et al. | |
| 4,567,930 | A | 2/1986 | Fischer | |
| 4,576,072 | A | 3/1986 | Terpstra et al. | |
| 4,589,312 | A | 5/1986 | Meyers et al. | |
| 4,589,313 | A | 5/1986 | Meyers et al. | |
| 4,606,099 | A | 8/1986 | Schluep et al. | |
| 4,619,166 | A | 10/1986 | Valavaara | |
| 4,625,868 | A | 12/1986 | Bischof | |
| 4,639,987 | A | 2/1987 | Georgopoulos | |
| 4,726,273 | A | 2/1988 | Miceli | |
| 4,730,372 | A | 3/1988 | Tsuchida | |
| 4,771,667 | A | 9/1988 | Forman et al. | |
| 4,776,096 | A | 10/1988 | Chang | |
| 4,790,226 | A | 12/1988 | Tsuchida | |
| 4,797,106 | A * | 1/1989 | Umehara et al. | 434/408 |
| 4,807,363 | A | 2/1989 | Clifton, Jr. | |
| 4,819,530 | A | 4/1989 | Huang | |
| 4,823,449 | A | 4/1989 | Chang | |
| 4,876,795 | A | 10/1989 | Chun-cheng | |
| 4,901,419 | A | 2/1990 | Voss | |
| 4,907,325 | A | 3/1990 | Hsu | |
| 4,907,337 | A | 3/1990 | Krüsi | |
| 4,924,740 | A | 5/1990 | Wright | |
| 4,928,369 | A | 5/1990 | Schnebly et al. | |
| 4,987,765 | A | 1/1991 | Nishimura et al. | |
| 4,993,131 | A | 2/1991 | Graves et al. | |
| D316,979 | S | 5/1991 | Reynolds | |
| 5,037,253 | A | 8/1991 | Molaro et al. | |
| 5,054,206 | A | 10/1991 | Carlson | |
| 5,056,388 | A | 10/1991 | Dekker et al. | |
| 5,060,709 | A | 10/1991 | Simon | |
| 5,072,494 | A | 12/1991 | Graves et al. | |
| 5,103,702 | A | 4/1992 | Yannazzone | |
| 5,119,854 | A | 6/1992 | Chanoine et al. | |
| 5,215,512 | A | 6/1993 | De Dompierre | |
| 5,251,382 | A | 10/1993 | Hellar | |
| 5,339,716 | A | 8/1994 | Sands et al. | |
| 5,349,730 | A | 9/1994 | Anderson et al. | |
| 5,392,524 | A | 2/1995 | Hill | |
| 5,456,149 | A | 10/1995 | Elsenheimer et al. | |
| 5,667,152 | A | 9/1997 | Mooring | |
| 5,740,053 | A | 4/1998 | Iwama | |
| 5,787,774 | A | 8/1998 | Richards et al. | |
| 5,799,557 | A | 9/1998 | Wang | |
| 5,806,245 | A | 9/1998 | Satrom | |
| 5,806,394 | A | 9/1998 | Marocco | |
| 5,816,126 | A | 10/1998 | Pluber | |
| 5,819,619 | A | 10/1998 | Miller et al. | |
| 5,826,317 | A | 10/1998 | van Oostrom et al. | |
| 5,882,155 | A | 3/1999 | Testa, Jr. | |
| 5,927,172 | A | 7/1999 | Wang | |
| 5,943,932 | A | 8/1999 | Sberveglieri | |
| 5,971,839 | A | 10/1999 | Schmelzer | |
| 6,003,217 | A | 12/1999 | Graves et al. | |
| 6,003,218 | A | 12/1999 | Schumann et al. | |
| 6,079,306 | A | 6/2000 | Liu | |
| 6,089,134 | A | 7/2000 | Marocco | |
| 6,098,694 | A | 8/2000 | Ohanesian | |
| 6,142,196 | A | 11/2000 | Schumann et al. | |
| 6,167,789 | B1 | 1/2001 | Daniels et al. | |
| 6,178,857 | B1 | 1/2001 | Marocco | |
| 6,196,099 | B1 | 3/2001 | Marocco | |
| 6,202,014 | B1 | 3/2001 | Brandt et al. | |
| 6,240,824 | B1 | 6/2001 | Hsu | |
| 6,314,851 | B1 | 11/2001 | Graves et al. | |
| 6,328,571 | B1 * | 12/2001 | Dricken et al. | 434/408 |
| 6,334,379 | B1 | 1/2002 | Sudano | |
| 6,336,388 | B1 | 1/2002 | Marocco | |
| 6,362,893 | B1 | 3/2002 | Francis et al. | |
| 6,405,406 | B1 | 6/2002 | Chen | |
| 6,412,381 | B1 | 7/2002 | Wang et al. | |
| 6,418,762 | B1 | 7/2002 | Münch et al. | |
| 6,427,571 | B1 | 8/2002 | Hsu | |
| 6,435,066 | B1 | 8/2002 | Kutchmarek et al. | |
| 6,500,048 | B1 | 12/2002 | Bär | |
| 6,535,294 | B1 | 3/2003 | Arledge, Jr. et al. | |
| 6,550,673 | B2 * | 4/2003 | Massaro | 235/383 |
| 6,560,849 | B1 | 5/2003 | Modra | |
| 6,561,121 | B1 | 5/2003 | Rose | |
| 6,604,443 | B2 | 8/2003 | Roberts et al. | |
| 6,615,698 | B2 | 9/2003 | Chuang et al. | |
| 6,644,160 | B1 | 11/2003 | Boselli | |
| 6,681,673 | B1 | 1/2004 | Kutchmarek et al. | |
| 6,688,204 | B2 | 2/2004 | Huang | |
| 6,758,120 | B2 | 7/2004 | Marocco | |
| 6,758,257 | B2 | 7/2004 | Lee | |
| 6,761,099 | B2 | 7/2004 | Lin et al. | |
| 6,783,563 | B1 | 8/2004 | Eckhoff et al. | |
| 6,793,073 | B2 | 9/2004 | Tu | |
| 6,865,817 | B2 | 3/2005 | Militello et al. | |
| 6,877,409 | B2 | 4/2005 | Huang et al. | |
| 6,912,940 | B1 | 7/2005 | Atwood | |
| 6,971,296 | B2 | 12/2005 | Lin et al. | |
| 6,973,364 | B2 | 12/2005 | Schwartz et al. | |
| 7,000,516 | B2 | 2/2006 | Lin et al. | |
| 7,000,521 | B1 | 2/2006 | Cheng et al. | |
| 7,007,576 | B2 | 3/2006 | Roberts et al. | |
| 7,017,459 | B2 | 3/2006 | Marocco | |
| 7,024,977 | B2 | 4/2006 | Nien | |
| 7,036,412 | B2 | 5/2006 | Abdollahzadeh | |
| 7,040,205 | B2 | 5/2006 | Roberts et al. | |
| 7,044,043 | B2 | 5/2006 | Cheng | |
| 7,059,230 | B2 | 6/2006 | Caputo et al. | |
| 7,069,832 | B2 | 7/2006 | Roberts et al. | |
| 7,069,833 | B2 | 7/2006 | Roberts et al. | |
| 7,100,485 | B2 | 9/2006 | Roberts et al. | |
| 7,100,780 | B1 * | 9/2006 | VanCalbergh et al. | 211/94.01 |
| 7,104,175 | B2 | 9/2006 | Roberts et al. | |
| 7,107,889 | B2 | 9/2006 | Marocco | |
| 7,114,421 | B2 | 10/2006 | Marocco | |
| 7,124,672 | B2 | 10/2006 | Marocco | |
| 7,178,439 | B2 | 2/2007 | Gilboy et al. | |
| 7,194,811 | B2 | 3/2007 | Militello et al. | |
| 7,195,213 | B2 * | 3/2007 | Weatherly | 248/125.1 |
| 7,278,345 | B2 | 10/2007 | Schimmels | |
| 7,444,910 | B2 | 11/2008 | Marocco | |

| | | | | |
|---|---|---|---|---|
| RE40,605 | E | 12/2008 | Kutchmarek et al. | |
| 7,467,578 | B2 | 12/2008 | Marocco | |
| 7,506,567 | B2 | 3/2009 | Simokovic | |
| D631,679 | S * | 2/2011 | Woelfel | D6/474 |
| D641,989 | S * | 7/2011 | Giroux et al. | D6/396 |
| 2003/0033919 | A1 | 2/2003 | Lin et al. | |
| 2003/0066403 | A1 | 4/2003 | Lin et al. | |
| 2003/0140756 | A1 | 7/2003 | Lin et al. | |
| 2003/0196530 | A1 | 10/2003 | Roberts et al. | |
| 2003/0205002 | A1* | 11/2003 | Gradecki | 49/409 |
| 2004/0103767 | A1 | 6/2004 | Lin et al. | |
| 2005/0102918 | A1* | 5/2005 | Richardson et al. | 52/79.1 |
| 2006/0065086 | A1* | 3/2006 | Swopes et al. | 83/13 |
| 2006/0108078 | A1 | 5/2006 | Kollman et al. | |
| 2006/0131250 | A1* | 6/2006 | Richardson et al. | 211/50 |
| 2006/0156882 | A1* | 7/2006 | Kollman et al. | 83/167 |
| 2006/0179991 | A1 | 8/2006 | Nien et al. | |
| 2006/0207399 | A1 | 9/2006 | Birch et al. | |
| 2007/0000363 | A1 | 1/2007 | Kollman et al. | |
| 2007/0239551 | A1 | 10/2007 | Zeller | |
| 2007/0271143 | A1* | 11/2007 | Dooley et al. | 705/14 |
| 2007/0277657 | A1 | 12/2007 | Hilgendorf et al. | |
| 2007/0295176 | A1 | 12/2007 | Kollman et al. | |
| 2008/0034933 | A1 | 2/2008 | Roberts et al. | |
| 2008/0066283 | A1 | 3/2008 | Birch et al. | |
| 2008/0087152 | A1 | 4/2008 | Kollman et al. | |
| 2008/0304224 | A1* | 12/2008 | Della Fiora et al. | 361/683 |
| 2009/0019978 | A1 | 1/2009 | Kollman | |
| 2009/0031876 | A1 | 2/2009 | Caputo et al. | |
| 2009/0071307 | A1 | 3/2009 | Kollman | |
| 2009/0107313 | A1 | 4/2009 | Nien et al. | |
| 2010/0107833 | A1 | 5/2010 | Caputo et al. | |
| 2010/0107839 | A1 | 5/2010 | Roberts et al. | |
| 2011/0210084 | A1* | 9/2011 | Hardy | 211/4 |

FOREIGN PATENT DOCUMENTS

| | | | |
|---|---|---|---|
| DE | 223048 | | 6/1910 |
| DE | 857677 | | 12/1952 |
| DE | 8810817 | U1 | 11/1988 |
| DE | 20105300 | U1 | 6/2001 |
| EP | 0265564 | A1 | 4/1988 |
| EP | 0273535 | A1 | 6/1988 |
| EP | 0629475 | A1 | 12/1994 |
| GB | 121338 | | 11/1970 |
| GB | 2258686 | A | 2/1993 |
| WO | 0107747 | A1 | 2/2001 |
| WO | 0110408 | A2 | 2/2001 |
| WO | 03010408 | A2 | 2/2003 |
| WO | 2008073829 | A1 | 6/2008 |

OTHER PUBLICATIONS

U.S. Appl. No. 12/579,897 dated Oct. 15, 2009.
U.S. Appl. No. 12/838,975 dated Jul. 19, 2010.
U.S. Appl. No. 12/838,993 dated Jul. 19, 2010.
U.S. Appl. No. 12/838,946 dated Jul. 19, 2010.
U.S. Appl. No. 12/838,958 dated Jul. 19, 2010.
U.S. Appl. No. 12/839,083 dated Jul. 19, 2010.
European Patent Office, Extended European Search Report, Application No. 11005918.5-1258, Apr. 20, 2012.
United States Patent and Trademark Office, U.S. Appl. No. 10/908,728, Restriction Requirement, Jul. 9, 2007.
United States Patent and Trademark Office, U.S. Appl. No. 10/908,728, Office Action, Oct. 4, 2007.
United States Patent and Trademark Office, U.S. Appl. No. 10/908,728, Final Office Action, Apr. 30, 2008.
United States Patent and Trademark Office, U.S. Appl. No. 10/908,728, Office Action, Oct. 8, 2008.
United States Patent and Trademark Office, U.S. Appl. No. 10/908,728, Final Office Action, Apr. 23, 2009.
United States Patent and Trademark Office, U.S. Appl. No. 10/908,728, Office Action, Mar. 2, 2011.
United States Patent and Trademark Office, U.S. Appl. No. 12/685,843, Restriction Requirement, Jun. 28, 2010.
United States Patent and Trademark Office, U.S. Appl. No. 12/685,843, Office Action, Aug. 19, 2010.
United States Patent and Trademark Office, U.S. Appl. No. 12/685,843, Final Office Action, Jan. 20, 2011.
European Patent Office, Partial European Search Report, Application No. 11005918.5-1268, Dec. 23, 2011.
Newell Window Furnishings, Inc., Chinese Application No. 201110246508.6, First Office Action, Sep. 13, 2012.

* cited by examiner

DISPLAY SYSTEM

The invention relates to a display system particularly suitable for use at a retail outlet.

BACKGROUND

Retail outlets such as so-called "big box" stores often display merchandise on shelving units where the shelving units are divided into bays and each bay may be further organized by specific product displays such as cases, bins, shelves or the like. Shelf space is limited such that the merchandise displays that efficiently utilize available space are desired.

SUMMARY

The display is for a shelving unit of the type having a bay defined in part by a lower horizontal support and an upper horizontal support spaced vertically above the lower horizontal support where the upper and lower horizontal supports may support a shelf deck. The display comprises a first rail mounted on and extending along the lower horizontal support and a second rail mounted on and extending along the upper horizontal support. A body is disposed between the first and second rail. The body is in low friction contact with the first rail and the second rail such that the body is freely movable along the length of the rails. The body supports a user interface.

The user interface may be operatively connected to a machine and the machine may be co-located with the shelving unit. The user interface may be operatively connected to a processor. The body may support a product sample such as a window covering. The machine may be a window covering cutting machine. The body may be vertically aligned with the first rail and the second rail. The user interface may comprise a flat touch panel monitor. The front of the body may comprise a display area adapted to support a product sample such as a faux window. The supports may comprise rigid rods having a plastic washer or bushing mounted near a distal end thereof. The first rail may mount on the lower horizontal support. The first rail may comprise an upwardly facing channel. The first rail may extend for substantially the entire length of the lower support. The second rail may comprise a downwardly extending channel that receives and retains the supports. The second rail may comprise a downwardly extending channel that is open towards the first rail and that extends for substantially the length of the upper horizontal support. The rods may extend into the channel such that the bushings may slide in the channel.

A method of display for a shelving unit of the type having a bay defined in part by a lower horizontal support and an upper horizontal support spaced vertically above the lower horizontal support where the upper and lower horizontal supports may support a shelf deck comprises locating a machine in a bay below the lower support; supporting co-located merchandise related to the machine; mounting a first rail on the lower horizontal support and a second rail on the upper horizontal support; supporting a body between the first rail and the second rail such that the body is freely movable along the length of the rails; supporting a display on the body; and controlling the machine with the display. A sample of the merchandise may be mounted on the body. The machine may comprise a window covering cutting machine and the merchandise may comprise a window covering.

DETAILED DESCRIPTION OF EMBODIMENTS OF THE INVENTION

Figure 1:
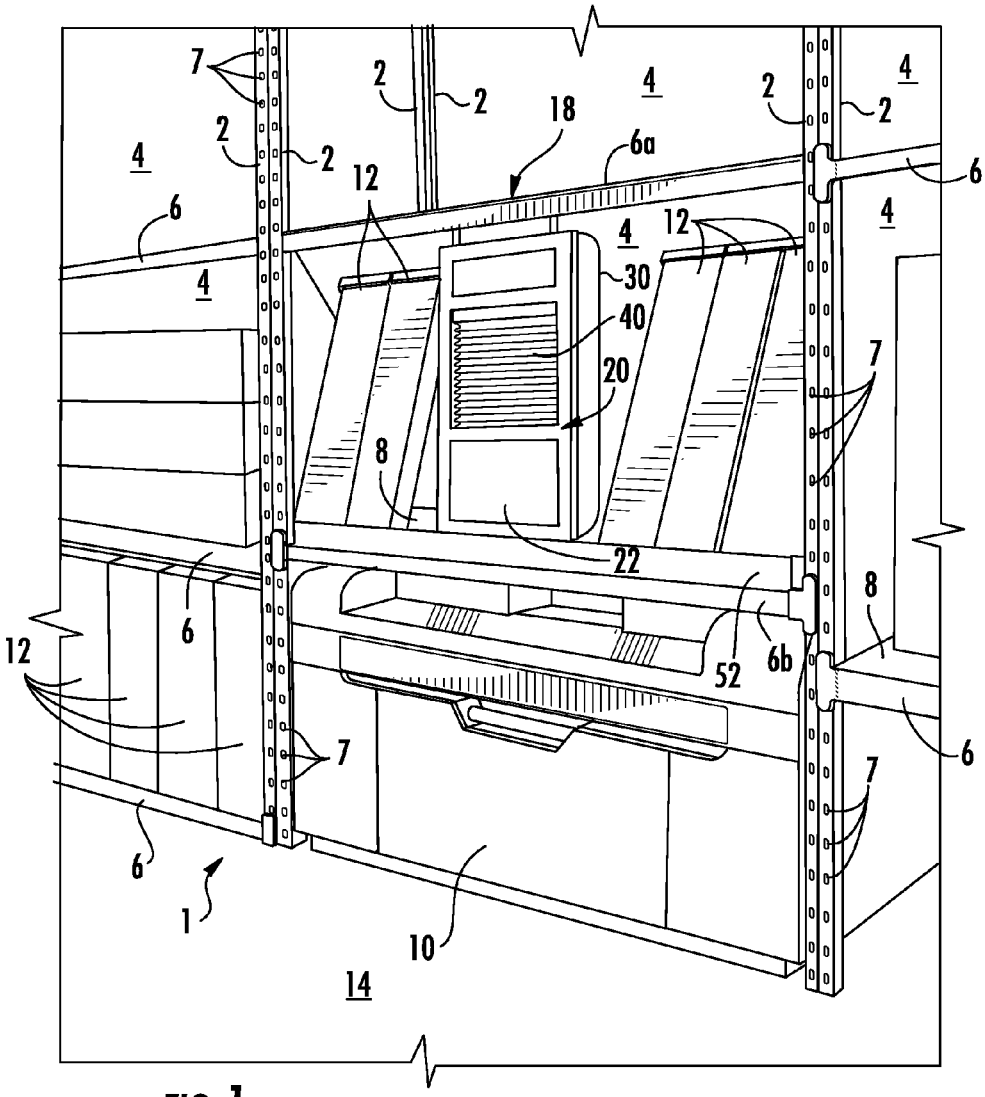
FIG. 1 shows an example embodiment of a retail product shelving unit, machine and merchandise used with an embodiment of the display of the invention.

Referring to the FIG. 1, an example of a typical shelving system 1 used at a retail outlet is shown. The shelving system 1 comprises vertical uprights 2 that are spaced to define a plurality of bays 4 arranged one next to the other. The vertical uprights are typically steel beams having a cross-section that provides a rigid support such as a box beam, I-beam, L-beam or the like. Typically, each bay 4 is defined by four uprights 2 arranged at the four corners of the rectangular bay. Each bay 4 is typically arranged to have a standard height, width and depth. The vertical uprights 2 are connected together by horizontal supports 6 that rigidly secure the vertical supports together and that act as supports for decking 8. The horizontal supports are typically steel beams having a cross-section that provides a rigid support as described above. The decking 8 forms shelves such that one bay 4 may support multiple vertically spaced shelves. In the illustrated embodiment the vertical uprights 2 include a series of vertically spaced apertures 7 that are engaged by mating keyed pins, not shown, formed at the ends of the horizontal beams 6. The pins may be inserted into the apertures 7 to fix the beams 6 to the vertical supports 2 without using tools or separate fasteners as is known. While a boltless system is shown and described, the various components of the shelving system may be connected by other types of mechanisms including separate fasteners. The horizontal supports 6 may be located at any of the vertically spaced positions defined by apertures 7 such that multiple configurations of the shelving unit are possible. While a specific embodiment of a shelving system is shown and described, the display system of the invention may be used with any similar storage system.

In the illustrated embodiment a bottom bay of the shelving unit 1 holds a window blind cutting machine 10. Such machines are disclosed in U.S. patent application Ser. No. 10/378,320, filed on Mar. 3, 2003 the disclosure of which is incorporated herein by reference in its entirety; and U.S. patent application Ser. No. 12/164,839, filed on Jun. 30, 2008 the disclosure of which is incorporated herein by reference in its entirety. These machines cut window coverings 12 (shown as displayed in the retail setting) to a customer specified size in the retail outlet. A customer may select one of the window coverings 12 and have it cut to the customer's desired size in machine 1. In some applications and with some cutting machines, the cutting machines are supported on wheels and are stored on the floor in the bottom bay such that the cutting machine 10 may be pulled from the bay into the aisle 14 during use. The window coverings 12 are typically stocked in a bay adjacent to or co-located with the cutting machine 10. The term "co-located" as used herein means bays or shelving units that are adjacent to one another where the merchandise, displays and/or equipment are related to one another.

The cutting machine 1 may use a user interface 20 to allow the user to input information to the machine and to display information to the user and control the functions or operation of the cutting machine. The user interface 20 may comprise a touchpanel monitor 22. Other user interfaces may also be used such as a monitor and separate input device such as a keyboard, joystick, audio speakers, a microphone and voice recognition technology, wireless communication technology, joy sticks, thumbwheels or the like. In the illustrated device the monitor 22 may be connected to a processor 26, such as the processor controlling the operation of machine 1, by cables or a wireless connection 24 such that the user interface 20 may communicate with the processor.

While one application of the user interface 20 is shown in the attached drawings, the user interface 20 may be used in any application where a user interface in a retail outlet or a user interface associated with shelving units is desired. Moreover, while the user interface 20, in the embodiment described with respect to FIG. 1, is used to control the functions of a machine co-located with the user interface 20, the user interface 20 may perform other functions. The user interface 20 may be used as a marketing device to provide information to the customer regarding co-located products, it may be used to provide general store or product information to, or receive such information from, the customer where the information is not related to co-located products. The user interface 20 may also be used by store personnel to perform functions related to the operation of the retail outlet.

The user interface 20 may also be connected to processor 26 where the processor is not related to the operation of a co-located machine such as, for example, when the user interface 20 is used to provide general information to the customer. In such a use the user interface 20 may be connected to a local processor such as a PC or it may be connected to a remote processor via a wired or wireless connection. The display may also be connected to a network such as a LAN, or the Internet.

Because shelf space is limited, the user interface 20 is mounted as part of display 18 that does not use shelf space, block inventory or limit access to the bays. The display 18 comprises a body 30 that supports the user interface 22. User interface 20 is supported on the front 30 of body 30 where it may be accessed by a user standing in front of the bay. The term "front" as used herein means facing away from the shelving unit. In the illustrated embodiment the user interface 20 comprises a flat touchpanel monitor 22 where the monitor can display information to the user and receive input from the user. A flat touchpanel monitor 22 takes up a minimum amount of horizontal space to maintain the narrow profile of the body 30.

Figure 2:
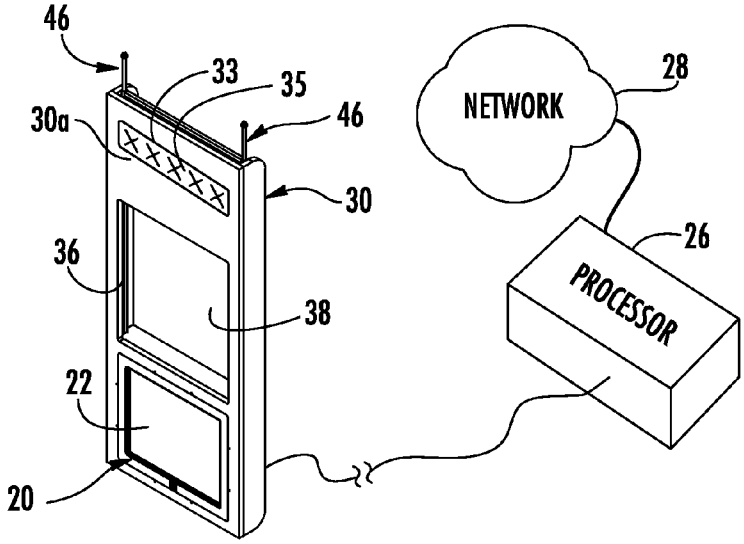
FIG. 2 is a perspective view showing the body of the display of FIG. 1.
Figure 3:
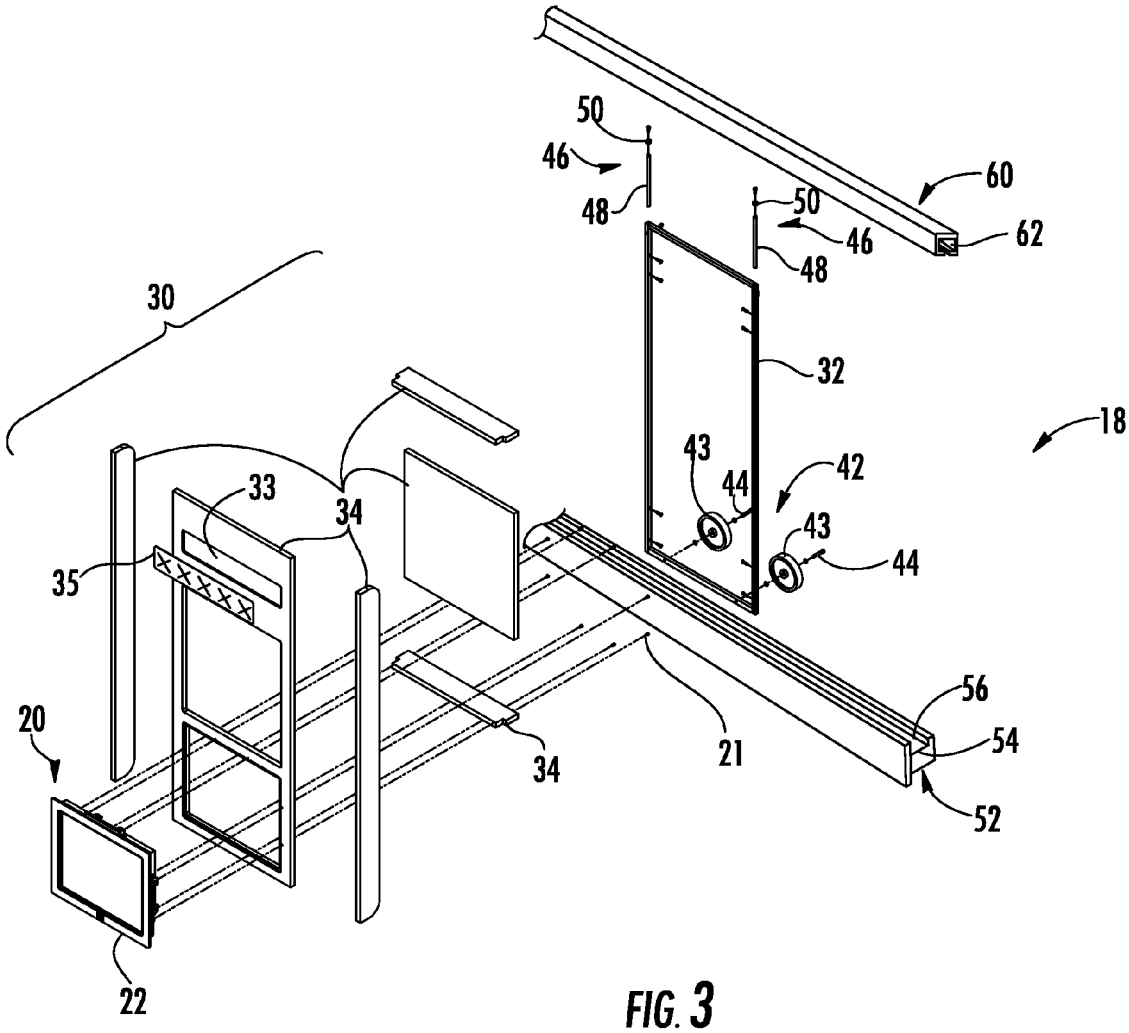
FIG. 3 is an exploded view of the display shown in FIG. 1.
Figure 4:
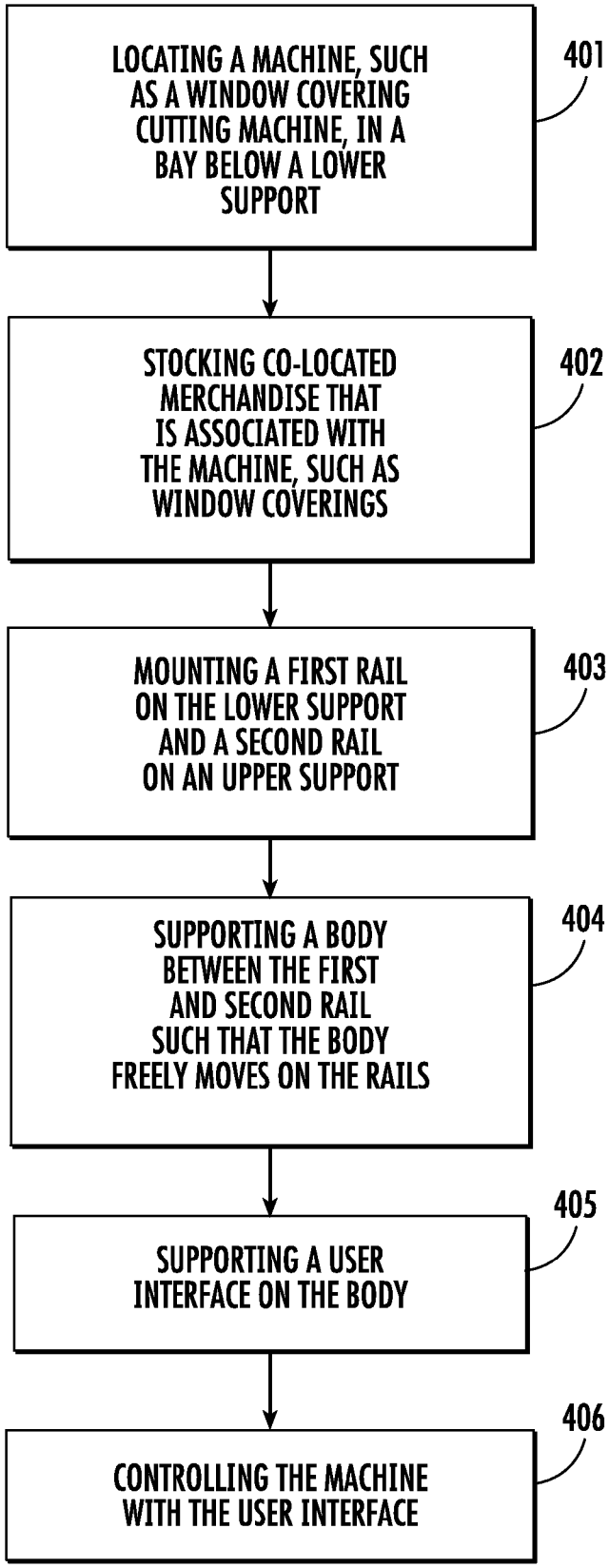
FIG. 4 is a block diagram illustrating a method of operating the display.

Referring to FIGS. 2 and 3, the body 30 is dimensioned to substantially span two vertically spaced horizontal supports of shelving unit 1, upper horizontal support 6*a* and lower horizontal support 6*b*. In one embodiment the body 30 comprises a rigid frame 32 made of plastic, metal or other rigid material that is covered by decorative trim pieces 34. The body 30 may be made as one piece such as a molded plastic part or have any other suitable construction. Preferably the body 30 has a narrow depth such that when it is mounted on the shelving unit 1 it is disposed between the upper horizontal support 6*a* and the lower horizontal support 6*b* and projects a minimum distance into the bay 4 and into the aisle 14. The user interface 20 may be connected to the body using any suitable attachment mechanism. In the illustrated embodiment, the touchpanel monitor 22 is secured to frame 32 using fasteners such as screws 21.

The front 30*a* of the body 30 also includes a display area 36 in which a product sample or other tangible article may be mounted and displayed to the user. In the illustrated embodiment the display area is related to the displayed article comprises a recessed faux window 38 that may be used to display a sample functional window covering 40. The sample window covering 40 may be suspended in the window 38 in the same manner that a real window covering is used in an actual window such that the user can view and manipulate the window covering 40. A sample window covering 40 is shown mounted in a faux window 38; however, the display area 36 cold take other forms and the sample product may be other than a window covering. In one embodiment the displayed article is related to the information displayed on user interface 22 and to merchandise co-located with the display 18. The front of the body may also include an area 33 for indicia 35 such as a logo.

Mounted to the lower end of body 30 is a low friction support 42 that allows body 30 to smoothly and easily traverse a horizontal surface. In the illustrated embodiment the low friction support 42 comprises a pair of wheels 43. The low friction support 42 may also comprise rollers, ball bearings, a low friction surface such as polytetrafluoroethylene, casters or the like. Wheels 43 are mounted on axles 44 such as shoulder bolts that are secured to the frame 32 such that the axis of rotation of the wheels 43 is perpendicular to the front 30*a* of body 30 and the body can move in a lateral direction across the front of the bay. The wheels 43 extend below the lower edge of the body 30 such that the body may ride on the wheels 43.

Mounted to the upper end of the body 30 are supports 46 that extend from the top of body 30 and are dimensioned to extend to the upper horizontal support 6*a*. The supports 46 comprise rigid rods 48 that have a plastic washer or bushing 50 or other low friction device mounted near the distal end thereof.

Referring to FIGS. 1 and 3 a first rail 52 is disposed below the body 30 and comprises a flat surface 54 on which the low friction support 42 travels. The rail 52 is mounted on the lower horizontal support 6*b* of the shelving unit 1. Alternatively, the rail may be made integrally with the lower horizontal support 6*b*. The rail 52 may comprise a channel 56 that extends the length of the rail 52 to guide the low friction support 42 when the body 30 is moved. The rail 52 extends for substantially the entire length of lower horizontal support 6*b* such that the rail spans the width of a bay.

A second rail 60 is disposed vertically above and in vertical alignment with lower rail 52. In operation rail 60 is disposed above body 30 and includes a channel 62 that receives and retains supports 46. The rail 60 comprises a channel 62 that extends the length of the rail 60. The channel has a C-shaped cross-section and is open in the downward direction facing rail 52. The rods 48 extend into channel 62 with the bushings 50 disposed inside of the channel such that the bushings may slide in the channel. Supports 46 maintain the body 30 in a vertical orientation. The rail 60 is mounted to the upper horizontal support 6*a* of the shelving unit where the upper horizontal support 6*a* is disposed above the first horizontal support 6*b* a distance such that the low friction support 42 can ride on rail 52 and the supports 46 are received in channel 62. Alternatively, the rail 60 may be made integrally with the upper horizontal support 6*a*. The rail 60 extends for substantially the entire length of the upper horizontal support 6*a* such that the rail spans the width of the bay.

The user can access user interface 20 to perform whatever function is enabled by the user interface including operating window covering cutting machine 1. Moreover, the display 18 may be moved along the rails 52 and 60 from one end of the bay to the opposite end of the bay. The low friction support 42 moves freely on rail 52 and the supports 46 slide freely in channel 62 such that, to reposition the body 30, the user simply pushes on the body 30 to slide the body transversely along the front of the bay. Because of the narrow profile of the display 18, it does not extend into the bay 4 or the aisle 14 because it is in a substantially vertical line with the upper and lower horizontal supports 6*a*, 6*b* of shelving unit 1. The body 30 extends substantially between the upper horizontal support 6*a* and the lower horizontal support 6*b* where the display would obstruct the bay 4 and shelf 8 and any merchandise stored on the shelf if it was not movable. However, because the body 30 can freely move over rails 52 and 64 across the width of the bay, the entire bay is usable space and merchandise stored on the shelf is accessible.

A method of using the display will be described. A machine is located in a bay below a lower horizontal support (block 401). Co-located merchandise is displayed that is associated with the machine (block 402). A first rail is mounted on the lower horizontal support and a second rail is mounted the upper horizontal support (block 403). A body is supported between the first rail and the second rail such that the body is freely movable along the length of the first rail and the second rail (block 404). A user interface is supported on the body (block 405). The machine is controlled with the user interface (block 406).

Specific embodiments of an invention are described herein. One of ordinary skill in the art will recognize that the invention has other applications in other environments. In fact, many embodiments and implementations are possible. The following claims are in no way intended to limit the scope of the invention to the specific embodiments described above.

The invention claimed is:

1. A display for a shelving unit of the type having a bay defined in part by a lower horizontal support and an upper horizontal support spaced vertically above the lower horizontal support where the upper and lower horizontal supports are adapted to support a shelf deck, comprising:

a first rail extending along said lower horizontal support;

a second rail extending along said upper horizontal support;

a body disposed between said first rail and said second rail, a low friction support supporting said body on said first rail and a support extending from said body, said support being in sliding contact with said second rail such that said body is freely movable along the length of the rails such that the body may be moved to and maintained at any position along the first rail and the second rail;

a user interface device supported by said body where the user interface device is operatively connected to a window covering cutting machine that is co-located with the user interface device, the user interface device being adapted to input information to control operation of the window covering cutting machine and to display information related to the operation of the machine.

2. The display of claim 1 wherein the user interface device is operatively connected to a processor and the processor controls operation of the window covering cutting machine.

3. The display of claim 1 wherein said body supports a product sample.

4. The display of claim 3 wherein the product sample is a window covering.

5. The display of claim 1 wherein said body is vertically aligned with the first rail and the second rail.

6. The display of claim 1 wherein the user interface device comprises a touchpanel monitor.

7. The display of claim 4 wherein a front of the body comprises a display area adapted to support the window covering and the display area is a faux window.

8. The display of claim 1 wherein the support comprises a rigid rod having a bushing mounted near the distal end thereof.

9. The display of claim 1 wherein the first rail is mounted on the lower horizontal support and the second rail is mounted on the upper horizontal support.

10. The display of claim 1 wherein the first rail defines an upwardly facing channel.

11. The display of claim 1 wherein the first rail extends for substantially the entire length of the lower horizontal support.

12. The display of claim 1 wherein the second rail comprises a downwardly extending channel that receives and retains the support.

13. The display of claim 1 wherein the second rail comprises a downwardly extending channel that is open facing the first rail and that extends for substantially the length of the upper horizontal support.

14. The display of claim 13 wherein the support comprises a rod having a plastic bushing that extends into the downwardly facing channel with the bushing disposed inside of the downwardly facing channel such that the bushing slides in the downwardly facing channel.

15. The display of claim 1 wherein the low friction support comprises a wheel.

16. The display of claim 15 wherein the wheel rolls on the first rail.

17. A method of display for a shelving unit of the type having a bay defined in part by a lower horizontal support and an upper horizontal support spaced vertically above the lower horizontal support where the upper and lower horizontal supports are adapted to support a shelf deck comprising:

locating a window covering cutting machine in a bay below the lower support;

displaying co-located window coverings associated with the window covering cutting machine;

mounting a first rail on said lower horizontal support and a second rail on said upper horizontal support;

supporting a body between said first rail and said second rail such that said body is freely movable along the length of the first rail and the second rail between a first position where a first plurality of the co-located window coverings are inaccessible behind the body and a second position where the first plurality of the co-located window coverings are accessible;

supporting a user interface on said body where the user interface device is operatively connected to the window covering cutting machine;

selecting one of the first plurality of window coverings when the body is in the second position and placing the one of the first plurality of window coverings in the window covering cutting machine;

controlling the window covering cutting machine with said user interface and displaying information related to the operation of the machine on the user interface.

18. The method of claim 17 further comprising mounting a sample of the window coverings on said body.

19. A display and a shelving unit comprising:

a bay defined in part by a lower horizontal support and an upper horizontal support spaced vertically above the lower horizontal support where the upper and lower horizontal supports are adapted to support a shelf deck;

a plurality of co-located window coverings associated with the machine stored in the bay;

a first rail extending along said lower horizontal support;

a second rail extending along said upper horizontal support;

a body disposed between said first rail and said second rail such that said body is freely movable along the length of the rails in front of the plurality of co-located window coverings;

a user interface supported by said body where the user interface is operatively connected to a window covering cutting machine that is co-located with the user interface, the user interface being adapted to input information to control operation of the window covering cutting machine and to display information related to the operation of the machine.

20. The display of claim 19 wherein said body defines a faux window and supports a functional window covering disposed in the faux window.

* * * * *